US005961233A

United States Patent [19]

Sano

[11] Patent Number: 5,961,233

[45] **Date of Patent: *Oct. 5, 1999**

[54] CONTINUOUS PAPER CUTTING DEVICE FOR A THERMAL PRINTER

[75] Inventor: Masaaki Sano, Yamanashi, Japan

[73] Assignee: NEC Corp., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/942,827

[22] Filed: Oct. 2, 1997

Related U.S. Application Data

[63] Continuation of application No. 08/643,080, May 2, 1996, abandoned, which is a continuation of application No. 08/503,184, Jul. 17, 1995, abandoned.

[30] Foreign Application Priority Data

Jul. 20, 1994 [JP] Japan ..... 6-168136

[51] Int. Cl.[6] ..... B41J 11/70

[52] U.S. Cl. ..... 400/621; 400/593

[58] Field of Search ..... 400/582, 583, 400/583.3, 593, 613.2, 621, 708; 221/25, 26; 225/1, 2, 91, 92

[56] References Cited

U.S. PATENT DOCUMENTS

| | | | |
|---|---|---|---|
| 3,503,834 | 3/1970 | Schroter | 400/583.3 |
| 4,566,606 | 1/1986 | Kling | 221/25 |
| 4,968,165 | 11/1990 | Karube et al. | 400/583 |
| 5,188,470 | 2/1993 | Matsubara et al. | 400/621 |
| 5,358,140 | 10/1994 | Pellegrino | 221/26 |
| 5,518,329 | 5/1996 | Beaudry | 400/621 |

FOREIGN PATENT DOCUMENTS

| | | | |
|---|---|---|---|
| 35 16 912 | 11/1985 | Germany | 400/621 |
| 60-019573 | 1/1985 | Japan | 400/621 |
| 3-053960 | 3/1991 | Japan | 400/583 |

*Primary Examiner*—John Hilten
*Attorney, Agent, or Firm*—Laff, Whitesel & Saret, Ltd.

[57] ABSTRACT

In a thermal printer, a continuous paper cutting device has an upper and a lower separator located downstream of a platen in the intended direction of paper transport and positioned to face each other with the intermediary of a continuous paper. The upper and lower separators are each provided with an arcuate end in place of a sharp edge for cutting the paper. The paper is formed with notches at opposite ends of each perforation. When a peforation immediately following the printed part of the paper reaches a predetermined position downstream of the arcuate ends of the separators in the direction of paper transport, the paper is brought to a stop. Therefore, the device allows the operator to separate the printed part from the paper along the perforation without resorting to cutters having sharp edges.

7 Claims, 3 Drawing Sheets

CONTINUOUS PAPER CUTTING DEVICE FOR A THERMAL PRINTER

This application is a continuation of application Ser. No. 08/643,080, filed May 2, 1996 which, in turn, was a continuation of Ser. No. 08/503,184 filed Jul. 17, 1995, both abandoned.

BACKGROUND OF THE INVENTION

The present invention relates to a device for cutting a continuous paper and included in a thermal printer and, more particularly, to a continuous paper cutting device for a thermal printer of the type conveying a continuous paper by rotating a platen formed of an elastic material having a great coefficient of friction.

A thermal printer of the type described has a thermal head and a platen facing the head and formed of an elastic material having a great coefficient of friction. The platen is driven by a stepping motor via a gearing so as to convey a continuous paper. The head is constantly biased toward the platen by a spring and is pivotally movable about a fixed shaft away from the platen against the action of the spring. The continuous paper is received in a storing section located upstream of the platen in the intended direction of paper transport. Perforations are formed in the paper at predetermined intervals in order to facilitate the separation of the paper. The paper is payed out from the storing section to between the head and the platen and conveyed by the platen. A sensor responsive to the consecutive perforations of the paper is located between the platen and the storing section.

An upper and a lower cutter, each having a sharp edge, are positioned downstream of the platen in the direction of paper transport. After an image has been printed on the leading part of the paper by the head and platen, the paper is brought to a stop when the peforation immediately following the printed part reaches the upper and lower cutters. On sensing the above perforation, the sensor outputs a signal for causing it to be accurately stopped at the cutters.

To cut the paper, the operator pulls the paper, stopped at the above position, either obliquely upward or obliquely downward. Because the paper has its trailing portion nipped by the head and the platen, it is cut along the perforation by the sharp edges of the cooperative cutters. Subsequently, the paper is again conveyed until the first print line of its trailing portion arrives at the head. In this position, the paper waits for the next printing operation.

A problem with the conventional continuous paper cutting device is that the sharp edges of the cutters sequentially wear due to repeated cutting. Therefore, the cutters must be replaced periodically. Because a preselected format is printed on each of the consecutive sheets of the continuous paper divided by the perforations, an image must be accurately printed within the frame of the format. Hence, if the perforation of the paper is not accurately stopped at the edges of the cutters, then the paper will be cut or torn off at a position other than the perforated portion. To obviate this occurrence, it is necessary to accurately control the distance between the thermal head and the sensor responsive to a detection of the perforation and due concern for the distance between the edges of the cutters and the above sensor. Or, it is necessary to use two sensors responsive to the printing position and the cutter position, respectively. This results in a complicated construction and control. Moreover, because the related parts must also be provided with high accuracy, the production cost of the printer increases. Should the perforation fail to meet the cutters accurately, the paper would be cut at an unexpected portion other than the perforation.

SUMMARY OF THE INVENTION

It is, therefore, an object of the present invention to provide a continuous paper cutting device for a thermal printer and capable of allowing a continuous paper to be cut at a perforation without resorting to cutters having sharp edges, thereby obviating the wear of edges and the replacement of cutters.

It is another object of the present invention to provide a continous paper cutting device for a thermal printer and capable of simplifying the construction and control of the printer by allowing the stop position assigned to a perforation to vary over a certain range.

It is a further object of the present invention to provide a continuous paper cutting device capable of reducing the production cost of a thermal printer in which it is installed.

In a thermal printer having a thermal head and a platen facing the thermal head and formed of an elastic material having a high coefficient of friction, the platen being rotated to convey the continuous paper formed with notches at opposite ends of consecutive perforations, a continuous paper cutting device of the present invention has an upper separating member disposed above the continuous paper and downstream of the platen in the intended direction of paper transport, and a lower separating member disposed below the continuous paper and downstream of the platen in the above direction. The upper and lower separating members each has an arcuate edge at the downstream side in the above direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
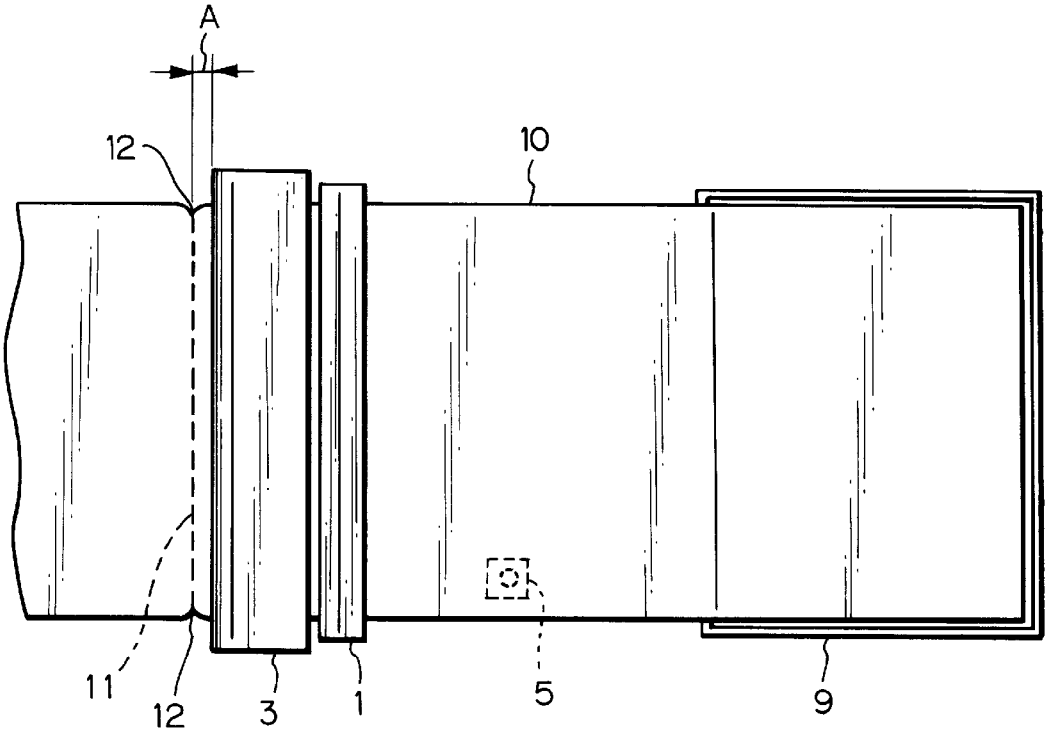
FIG. 1 is a plan view of at thermal printer having a continuous paper cutting device embodying the present invention.

To better understand the present invention, a brief reference will be made to a conventional device for cutting or tearing a continuous paper strip included in at thermal printer, as shown in FIG. 1. As shown, the conventional cutting device has an upper cutter 3 and a lower cutter 4 each having a sharp edge. A continuous paper 10 carrying an image thereon is brought to a stop when its perforation 11 meets the cutters 3 and 4. Then, the operator pulls the paper 10 obliquely upward or obliquely downward in order to cut or tear it along the perforation. This kind of configuration brings about the various problems discussed earlier.

Figure 2:
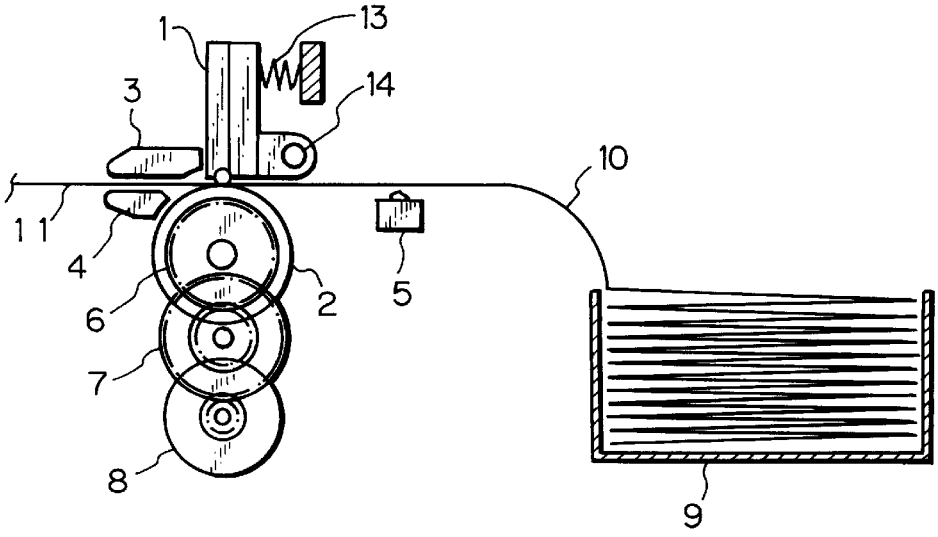
FIG. 2 is a section of the printer and cutting device shown in FIG. 1.

Referring to FIGS. 1 and 2, at thermal printer having a continuous paper cutting device embodying the present invention and free from the above described problems is shown. As shown, the printer has at thermal head 1 for printing an image on a continuous paper 10 by selectively heating it. A platen 2 faces the head 1 and is formed of an elastic material having a great coefficient of friction. A stepping motor 8 is drivably connected to the platen 2 by intermeshing gears 6 and 7. The head 1 is constantly biased toward the platen 2 by a spring 13. At the same time, the head 1 is pivotally movable away from the platen 13 about a shaft 14 against the action of the spring 13. The paper 10 nipped by the head 1 and platen 2 is conveyed by the platen 2 when the platen 2 is driven by the motor 8.

The paper 10 which is applicable to the illustrative embodiment is formed with perforations 11 at preselected intervals, and with notches 12 on opposite sides of the paper and at opposite ends of each perforation 11. Usually, the continuous paper strip has a first to a sixtieth page divided by consecutive perforations. Each part of the paper strip 10 which is delimited by two consecutive perforations constitutes a single leaf or page having a preselected format printed thereon. Each page must always be cut or torn along the perforation.

Figure 3:
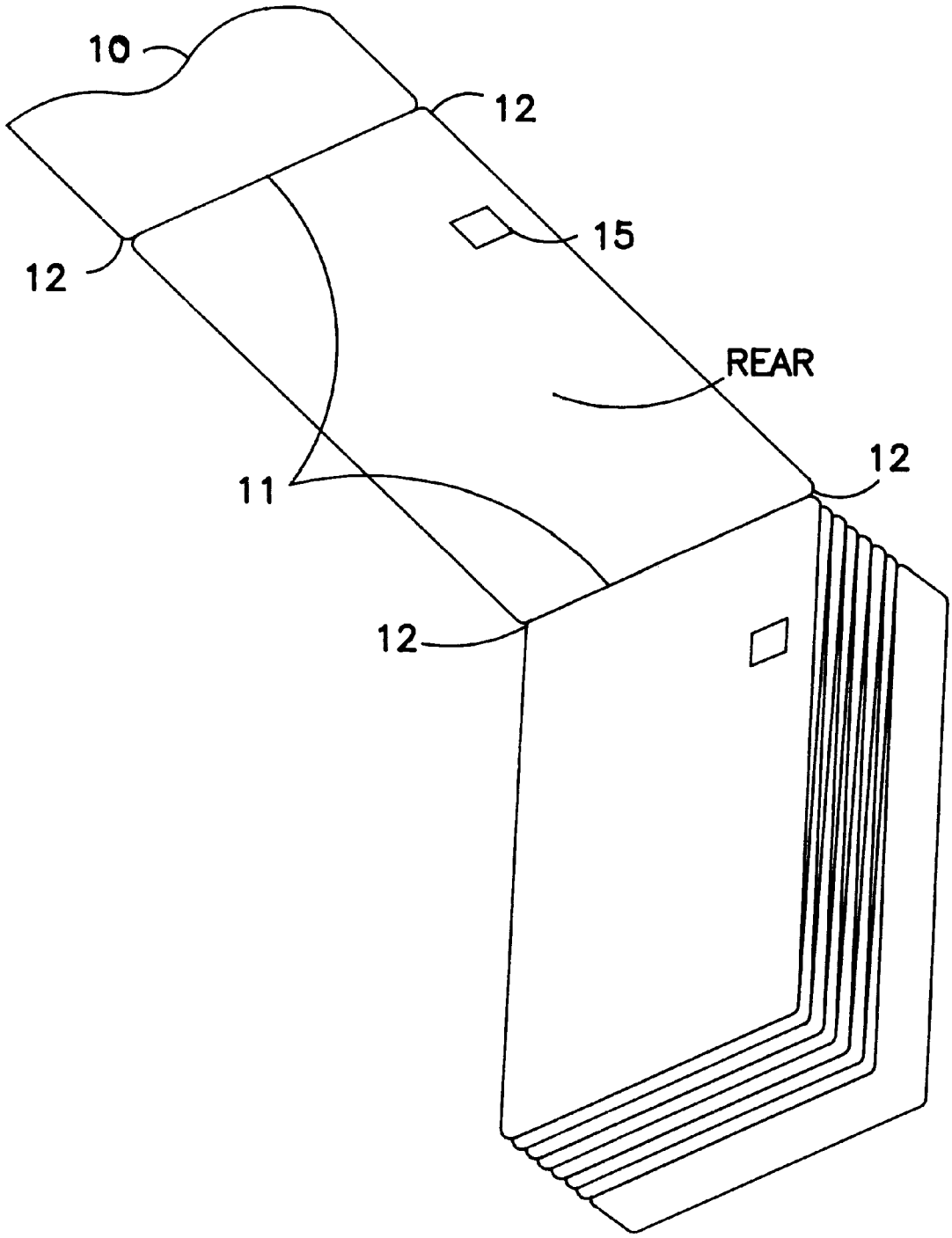
FIG. 3 is an external perspective view of a continuous strip of paper applicable to the printer shown in FIG. 1.

As shown in FIG. 3, a preferably black mark 15 is provided on the rear of each page of the paper 10 at a preselected distance from the preceding perforation 11 and at a preselected distance from the edge of the paper 10. The paper 10 is sequentially fan folded at the perforations 11 in a zigzag configuration and stored in a paper storing section 9 (FIG. 2) located behind the platen 2. The paper strip 10 is fed between the head 1 and the platen 2 so that the successive pages appear in sequence.

A paper transport path, which is the same width as the paper 10, is defined between the platen 2 and the paper storing section 9. The transport path defined by guides 16 prevents the paper 10 from being displaced in the widthwise direction.

Figure 4:
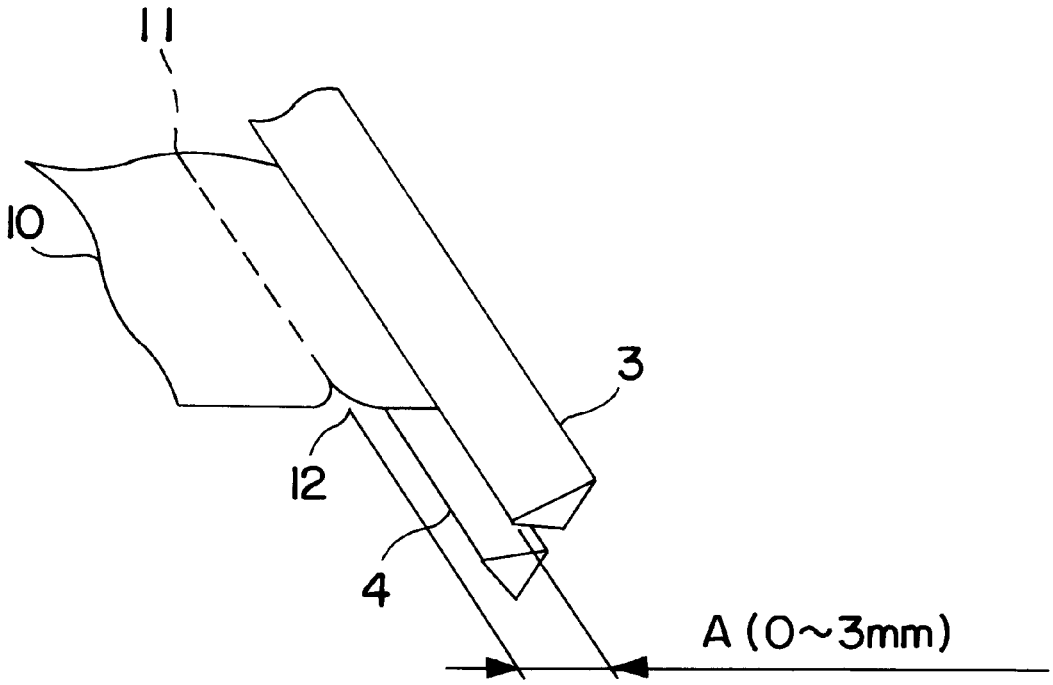
FIG. 4 is an external perspective view of the cutting device included in the embodiment.
Figure 5:
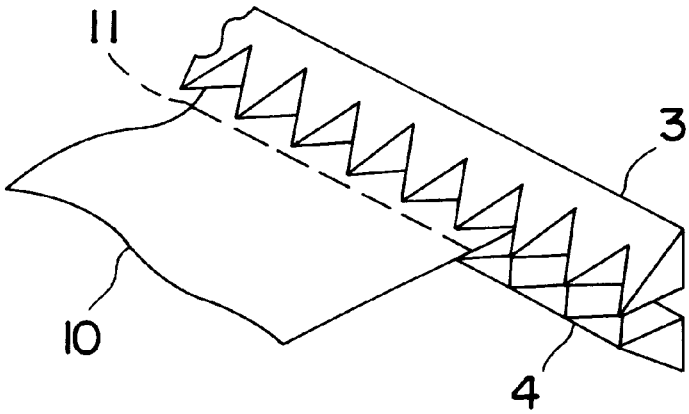
FIG. 5 PRIOR ART
FIG. 5 is a fragmentary external perspective view of a convention device for cutting a continuous paper.

A sensor 5 (FIG. 2) is located on the above transport path 16 at a position where it will align with the consecutive black marks 15 on the paper 10. The sensor 5 is implemented by a reflection type sensor having a light emitting diode (LED) and a phototransistor. When the LED emits light directed toward the rear of the paper 10, the resulting reflection is incident to the phototransistor. The phototransistor transforms the quantity of incident light into a corresponding voltage. When the black mark 15 is brought to above the sensor 5, the sensor 5 senses it on the basis of a change in the output voltage of the phototransistor. An upper separator 3 and a lower separator 4 are positioned downstream of the platen 2 in the direction of paper transport and located to face each other with the intermediary of the paper 10. The downstream ends of the upper and lower separators 3 and 4 in the direction of paper transport are not implemented as sharp edges, but they are each provided with an arcuate shape as shown in FIG. 4.

The distance between the perforation 11 and the black mark 15, the distance between the separators 3 and 4 and the head 1, and the distance between the head 1 and the sensor 5 are all selected to satisfy the following relationship. After the sensor 5 has sensed the black mark 15, the stepping motor 8 drives the paper 10 a preselected number of steps and then stops it. In this condition, the first line of the first page of the paper 10 is located at the head 1. At the same time, as shown in FIGS. 1 and 4, the perforation 11 of the paper lies in a preselected range (a distance A of about 0 mm to 3 mm) as measured from the front ends of the separators 3 and 4.

In the illustrative embodiment, the distance between the head 1 and the sensor 5 is accurately controlled because the printing position of the first line is important. By way of contrast, the separators 3 and 4 do not need an accurate mounting position because the distance between the separators 3 and 4 and the head 1 has a tolerance allowance corresponding to the distance A.

In operation, the printer prints out a single group or block of data on all of the appropriate lines on a single page. Specifically, after the paper 10 has been loaded in the printer, its leading edge is inserted between the head 1 and the platen 2. Then, the paper 10 is conveyed so that the first line of the first page of the paper 10 arrives at the head 1 while the perforation 11 of the paper 10 lies in the preselected range A as measured from the front ends of the separators 3 and 4. This operation is performed only when the paper 10 is first loaded in the printer.

In response to the image data, the stepping motor 8 drives the platen 2 until the head 1 fully prints out the data on all of the appropriate lines of the first page. The paper 10 is continuously conveyed until the sensor 5 senses the black mark 15. Then, the stepping motor 8 further conveys the paper 10 by the preselected number of steps and then stops it. As a result, the paper 10 is positioned so that the first line of the second page is located at the head 1 while the next perforation 11 lies within the preselected range A, as at the time when the paper 10 is first loaded in the printer.

The first page of the paper 10 is driven out of the printer while it is still connected to the second page at the perforation 11. In this condition, the operator holds the first page of the paper 10 and then pulls it obliquely upward or obliquely downward. Although a force tending to pull the paper 10 out of the printer acts on the paper 10, the second page is nipped between the head 1 and the platen 2 and thus prevented from being pulled out thereby. As a result, the pulling force is concentrated on the perforation 11 between the first and second pages, and particularly on the notch 12. It follows that the paper 10 begins to break at the notch 11. The breakage advances along the perforation until the first and second pages have been fully separated from each other. This process is repeated with the second page and each of the successive pages.

In summary, in accordance with the present invention, a continuous paper cutting device of the present invention and applicable to at thermal printer has an upper and a lower separator located downstream of a platen in the intended direction of paper transport and positioned to face each other with the intermediary of a continuous paper. The upper and lower separators are each provided with an arcuate end in place of a sharp edge for cutting the paper.

The paper is formed with notches at opposite ends of each perforation thereof. When a peforation immediately following the printed part of the paper reaches a predetermined position downstream of the arcuate ends of the separators in the direction of paper transport, the paper is brought to a stop. Therefore, the device allows the operator to separate the printed part from the paper along the perforation without resorting to cutters having sharp edges. The device is, therefore, free from the wear of cutters and obviates the need for the replacement of cutters.

Moreover, because the stop position assigned to the perforation is allowed to vary over a certain range as measured from the front ends of the separators, it is not necessary to control the stopped position of the perforation with great accuracy. In addition, the position of the separators 3, 4 relative to a thermal head is also variable over a reasonable distance. Consequently, the printer is simplified in construction and control. In addition, the overall production cost of the printer is reduced because the related parts do not need high machining accuracy.

Various modifications will become possible for those skilled in the art after receiving the teachings of the present disclosure without departing from the scope thereof.

What is claimed is:

1. A device for enabling a separation of a continuous strip of paper having successive sheets defined by perforations ending in notches on opposite side of the paper and being for use in at thermal printer having a thermal head, said device comprising:

a platen facing said thermal head and being formed of an elastic material having a high coefficient of friction, said platen being rotated to convey a continuous strip of paper, upper separating means disposed above the continuous paper and downstream of said platen relative to an intended direction of paper transport; and lower separating means disposed below the continuous paper and downstream of said platen in said direction;

said upper and lower separating means each having an arcuate edge at a downstream side relative to said direction of paper transport, said arcuate edge helping to separate a printed part of the continuous paper from the continuous paper, said separation being made along the perforation.

2. A device as claimed in claim 1, further comprising drive control means for causing said continuous paper to be conveyed to and brought to a stop at a position where one of a plurality of peforations immediately following a printed part of the continuous paper is spaced a predetermined distance from said arcuate edges of said upper and lower separating means.

3. A device as claimed in claim 2, wherein said predetermined distance is variable over a certain range.

4. A device as claimed in claim 2, wherein said drive control means comprises sensor means for sensing a perforation of the continuous strip of paper next following the printed part.

5. A device as claimed in claim 4, further comprising:

a paper storing section located upstream of said platen relative to the intended direction of paper transport, said storing section providing space for storing the continuous strip of paper; and a paper transport path extending between said platen and said paper storing section, said transport path having a width which is the same as the width of the continuous paper, said sensor means being located along said paper transport path.

6. A method of enabling and a separation of a continuous strip of paper loaded in a printer having at thermal head for printing out data on said continuous strip of paper, said printer also having a platen facing said thermal head, said platen being formed of an elastic material having a high coefficient of friction, and said platen rotating to convey said continuous paper, said method comprising the steps of:

(a) forming consecutive perforations in the continuous strip of paper, with notches in opposite edges of said paper and at opposite ends of each of said perforations;

(b) providing an upper separator and a lower separator facing each other and located downstream of said platen in an intended direction of paper transport, each of said upper and lower separator means having an arcuate front end, said separators having a space between them through which said paper passes; and (c) separating said paper responsive to step (b).

7. A method as claimed in claim 6, further comprising the steps of:

(c) conveying the continuous paper so that each of the consecutive perforations stops at a stop position lying within a preselected range as measured from front ends of said upper separator and said lower separator; and (d) separating printed sheets by pulling the continuous paper stopped at said stop position obliquely upward or obliquely downward.

* * * * *